US006386377B1

(12) United States Patent
Yeoman

(10) Patent No.: US 6,386,377 B1
(45) Date of Patent: May 14, 2002

(54) MOUNTING ASSEMBLY FOR PLURALITY OF MICROPHONES

(76) Inventor: Lenny Yeoman, 6741 Allen St., Hollywood, FL (US) 33024

( * ) Notice: Subject to any disclaimer, the term of this patent is extended or adjusted under 35 U.S.C. 154(b) by 0 days.

(21) Appl. No.: 09/668,281

(22) Filed: Sep. 25, 2000

(51) Int. Cl.[7] ..... A47F 7/00

(52) U.S. Cl. ..... 211/60.1; 211/26; 211/173; 248/183.2; D14/229

(58) Field of Search ..... 211/26, 13.1, 60.1, 211/170, 173, 70.1; 248/184.1, 183.2, 177.1

(56) References Cited

U.S. PATENT DOCUMENTS

| | | | | |
|---|---|---|---|---|
| 2,388,353 A | | 11/1945 | Watson | |
| 2,815,863 A | * | 12/1957 | Larson | |
| 3,794,284 A | | 2/1974 | Guenther | |
| D297,111 S | * | 8/1988 | Thompson et al. | |
| 5,028,048 A | | 7/1991 | Watson et al. | |
| 5,080,315 A | | 1/1992 | Tucker-Schafer | |
| 5,394,994 A | | 3/1995 | Coblentz et al. | |
| 5,490,599 A | * | 2/1996 | Tohidi | 211/171 |
| D377,310 S | * | 1/1997 | Crump | |
| D384,077 S | * | 9/1997 | Frasse | |
| 6,168,030 B1 | * | 1/2001 | Morris | 211/13.1 |

* cited by examiner

*Primary Examiner*—Robert W. Gibson, Jr.
(74) *Attorney, Agent, or Firm*—Malloy & Malloy, P.A.

(57) ABSTRACT

A mounting assembly structured to removably and collectively support a plurality of microphones in a predetermined, organized array, at a location wherein sound pick-up and/or amplification is required. The mounting assembly includes a base having an attachment assembly for removably and/or adjustably securing the base to anyone of a plurality of different support structures, wherein the base further includes a gripping assembly comprising a plurality of apertures each having a sufficient circumferential dimension to supportingly engage anyone of a plurality of differently configured microphones. At least some of the plurality of apertures comprising a closed circumferential configuration wherein others of the plurality of apertures comprise a substantially open circumferential configuration, which is at least partially defined by an access opening disposed in communicating relation with a peripheral edge of the base and the interior of a corresponding one of said open apertures. Each of the access openings include a transverse dimension which may be equal to or lesser than the corresponding aperture with which it communicates, wherein the access openings are dimensioned to allow passage therethrough of a cable connected to an individual microphone.

18 Claims, 4 Drawing Sheets

MOUNTING ASSEMBLY FOR PLURALITY OF MICROPHONES

BACKGROUND OF THE INVENTION

1. Field of the Invention

This invention is directed to a mounting assembly structured to removably support a plurality of microphones in a predetermined organized array, which is substantially defined by the microphones being disposed in laterally spaced relation to one another and protruding outwardly from a base of the mounting assembly so as to be efficiently aligned with a speaker, performer or other source of sound being generated. The removable support of anyone of the plurality of microphones is facilitated by a gripping assembly mounted on the base and structured to eliminate the conventional requirement of detaching the power or output cable from the microphone when supporting or removing the microphone from its intended, operative position.

2. Description of the Related Art

During the conducting of a speech, interview, press conference or like performance it is common practice to mount a plurality of different microphones at a substantially common location and in an operative orientation such that the voice of the speaker or other source of audio output can be picked up and/or amplified. The audio output is then transferred to a plurality of different distribution sites such as over networks and/or to various television or radio stations, etc. In that these different sources of audio and video distribution normally do not share common communication facilities, each of the different networks or stations must be individually represented and accordingly the sound being generated by the speech, press conference or other type of performance is picked up using individual microphones.

One type of conventional support structure utilized to mount or otherwise position a group of microphones is commonly known as a "light" stand. The light stand or equivalent type of support structure is positioned in an appropriate location, normally in front of or in direct communication with the speaker or other one or more persons involved in an audio performance. The plurality of individual microphones are then supported on the light stand, or other conventional support structure, utilizing a variety of clips, fasteners, connectors, "gaffers" tape or like devices, which accomplish a somewhat haphazard mounting of the plurality of individual microphones on the support structure. Such a conventional technique of grouping the plurality of microphones is demonstrated in FIG. 5, as set forth herein. FIG. 5, is representative of prior art attachment facilities of the type set forth above, which result in a disorganized conglomeration of microphones, the majority of which are not attached directly to the light stand or other conventional support structure, but rather rely on an insecure interconnection to one another. The disorganized array of microphones demonstrated in FIG. 5 clearly indicates that numerous ones of such microphones are not properly positioned or oriented to take advantage of their maximum audio pick-up and transmission capabilities.

This type of disorganized collection of microphones is at least partially attributable to the fact that many types of "performances" particularly press conferences, interviews and the like, which may be broadly classified as news events, are often conducted on a spontaneous or impromptu basis. Therefore the reporters, journalists or other responsible communication personnel frequently have only a minimal amount of "set-up" time in which to arrange the audio and/or video equipment in order to adequately cover a specific event, particularly when such event is broadcast or otherwise distributed on a live-feed basis.

Accordingly, there is a recognized need in the broadcasting or other related industries for an improved mounting assembly, which is capable of removably supporting a plurality of microphones at a common location and in a predetermined, organized array. Further, the plurality of collected microphones should be individually oriented in a most preferred operative position in order to take advantage of their maximum degree of audio sensitivity, thereby assuring that the audio performance being received will be of a preferred clarity and quality satisfactory for broadcast. Also, due to the aforementioned spontaneous or impromptu nature of such events, at which a plurality of individual microphones are collectively gathered, such an improved mounting assembly should be structured to quickly and efficiently allow attachment of the individual microphones thereon in the aforementioned proper, operative orientation. Also, due to the well recognized fact that the broadcasting industry is time oriented and frequently operates on predetermined schedules or "deadlines", the removal and/or detachment of the individual microphones from such an improved mounting assembly should also be accomplishable in a quick and easy manner.

It is also recognized that a large variety of different styles and models of microphones exist, each of which may include different configurations and dimensions. In addition, numerous conventional microphones include output or power cords permanently or removably attached thereto. Therefore, microphones incorporating such power or output cords should be easily accommodated to the extent of being mounted on and removed from the improved mounting assembly without regard to the existence of such cords or otherwise requiring the disconnection or detachment of the cord from the microphone, even when such detachment is permitted. Finally, such an improved mounting assembly should be formed of a light weight, high strength material and be otherwise structured to be attached to a conventional light stand or other commonly used support structure in a quick and easy manner.

SUMMARY OF THE INVENTION

The present invention is directed to a mounting assembly structured to collectively and removably support a plurality of similarly or differently configured, substantially conventional microphones in a predetermined organized array and in a substantially common location, such that each of the microphones may "pick-up" and/or amplify the sound produced by the delivery of a speech or interview or a variety of other audio performances. More specifically, the mounting assembly of the present invention is intended to eliminate the unorganized conglomeration of microphones, which are commonly disposed in a confusing interconnected array during news events, announcements, press conferences, etc. Further, the mounting assembly of the present invention comprises a base which may preferably be formed of a unitary, one piece construction and which also preferably, but not necessarily, comprises a substantially flat or planar configuration. The base includes an outer exposed surface and a substantially oppositely disposed under surface.

A gripping assembly is formed on the base and comprises a plurality of apertures extending through the base in open, communicating relation with both the exposed outer surface and the under surface. The apertures may vary in number, size configuration and relative location, but are also commonly characterized by a circumferential dimension which is sufficient to removably but supportingly engage the outer housing or casing of the microphone at a preferred location, generally intermediate the opposite ends thereof. In addition, each of the plurality of apertures is disposed, dimensioned and configured to facilitate the removably, supporting engagement with individual ones of the microphones, regardless of the dimension and configuration of the microphone. Moreover, the gripping assembly of the present invention facilitates the plurality of microphones being attached to and removed from the base, in a quick and efficient manner without requiring the temporary detachment of a power cord or out-put cable, which are normally associated with some types of conventional microphones.

In addition to the above, one or more of the plurality of apertures are spaced inwardly from a surrounding periphery of the base and are generally defined by a substantially closed circumferential configuration. At the same time, one or more of others of the plurality of apertures are disposed to extend along one or more of the peripheral edges of the base in spaced relation to one another. This latter group of apertures preferably includes a substantially open circumferential configuration. By varying the configuration and/or overall dimension of the various apertures, the base is structured to removably support conventional microphones, whether or nor such microphones require a power and/or out-put cable being attached thereto.

An attachment assembly is also secured to the base so as to removably and/or adjustably position the base in a preferred orientation on anyone of a plurality of different support structures such as, but not limited to, a "light stand" of the type conventionally used by reporters and like personnel during impromptu press conferences, speeches, etc.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 5:
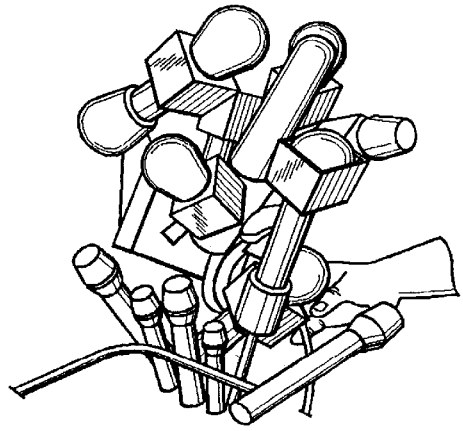
FIG. 5 PRIOR ART
FIG. 5 is a perspective view of a prior art structure for interconnecting and supporting a plurality of conventional microphones.

As shown in the accompanying figures, the present invention is directed to a mounting assembly 10 structured to removably support a plurality of conventional microphones, each of which may vary in size and configuration, in an organized, predetermined array so as to efficiently position each of the microphones in a preferred operative orientation relative to a performer or other source of sound to be picked up and/or amplified. FIG. 5 represents a typical prior art conglomeration of microphones attached to one another by any number of conventional clips, tapes, connectors, etc. which the mounting assembly 10 of the present invention is designed to overcome. As shown therein the plurality of microphones are interconnected to one another and are collectively supported by a some type of stand or support assembly.

Figure 4:
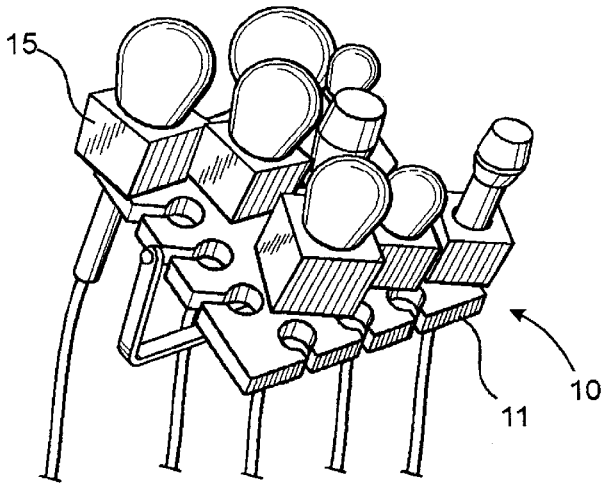
FIG. 4 is a perspective view of the embodiment of FIG. 3 with a plurality of conventional microphones mounted thereon in an organized, predetermined array.

To the contrary, the mounting assembly 10 of the present invention is structured to arrange the plurality of microphones in an organized, predetermined array generally defined by the microphones being disposed in adjacent, spaced relation to one another, as shown in FIG. 4. Moreover, when supported on the mounting assembly 10, the plurality of microphones are oriented in a preferred operative position so as to receive the sound produced or generated by a person or other audio source in a most efficient manner.

The mounting assembly 10 comprises a base generally indicated as 11, and preferably formed of a unitary, one piece construction which may be formed into a variety of different shapes, including a substantially flat or planar configuration. The base 11 has both an outer surface 13, which when in use generally faces the speaker, and an undersurface 16, which is substantially oppositely disposed to the outer surface 13, and faces away from the speaker when in use.

The base 11 comprises a gripping assembly 12, which may be defined by a plurality of apertures 20, that extend through base 11 in communicating relation with outer surface 13, and undersurface 16. Apertures 20 may vary in number, size, and location, but are preferably spaced from one another in an organized, predetermined array, such that when the plurality of microphones are concurrently supported, they will be disposed in spaced, side-by-side relation to one another, as shown in FIG. 4. Furthermore, while the configuration of the plurality of apertures 20 may vary, each of the apertures 20 includes a substantially common structural characteristic comprising a sufficient circumferential dimension to supportingly and removably engage the outer casing or housing of the microphone at a location intermediate its ends. As described in greater detail hereinafter, the gripping assembly 12, comprising the plurality of apertures 20, is structured to accommodate microphones which may or may not include an attached power cord or output cord. The existence of such a cord determines which of the plurality of apertures 20 may best be used to accommodate a microphone and also determines how the microphone enters or is disposed in supporting engagement within appropriate ones of the plurality of apertures 20.

More specifically, the plurality of apertures 20 include at least one but preferably a first group of apertures, indicated as 19, which are characterized by a substantially closed circumferential configuration. Closed apertures 19, are disposed in inwardly spaced relation to the surrounding peripheral side edges 21 and 21' of base 11 and are primarily designed to accommodate microphones which are operable without the use of a power or output cord. The microphones are inserted into closed apertures 19, by placing one end, such as the tail end of the microphone, there through. As set forth above, one structural characteristic common to each of the plurality of apertures 20 is the circumferential dimension thereof which allows the removable, supporting engagement of any of a variety of different microphones with the peripheral portions of one of the plurality of apertures 20, at a location on the microphone, generally intermediate the ends thereof. In certain instances, and dependent on the size and configuration of certain conventional microphones, the enlarged head of the microphone and/or the informative banner or mount, indicated as 15 in FIG. 4, will be disposed in flush engagement with the outer surface 13 of the base 11.

Figure 1:
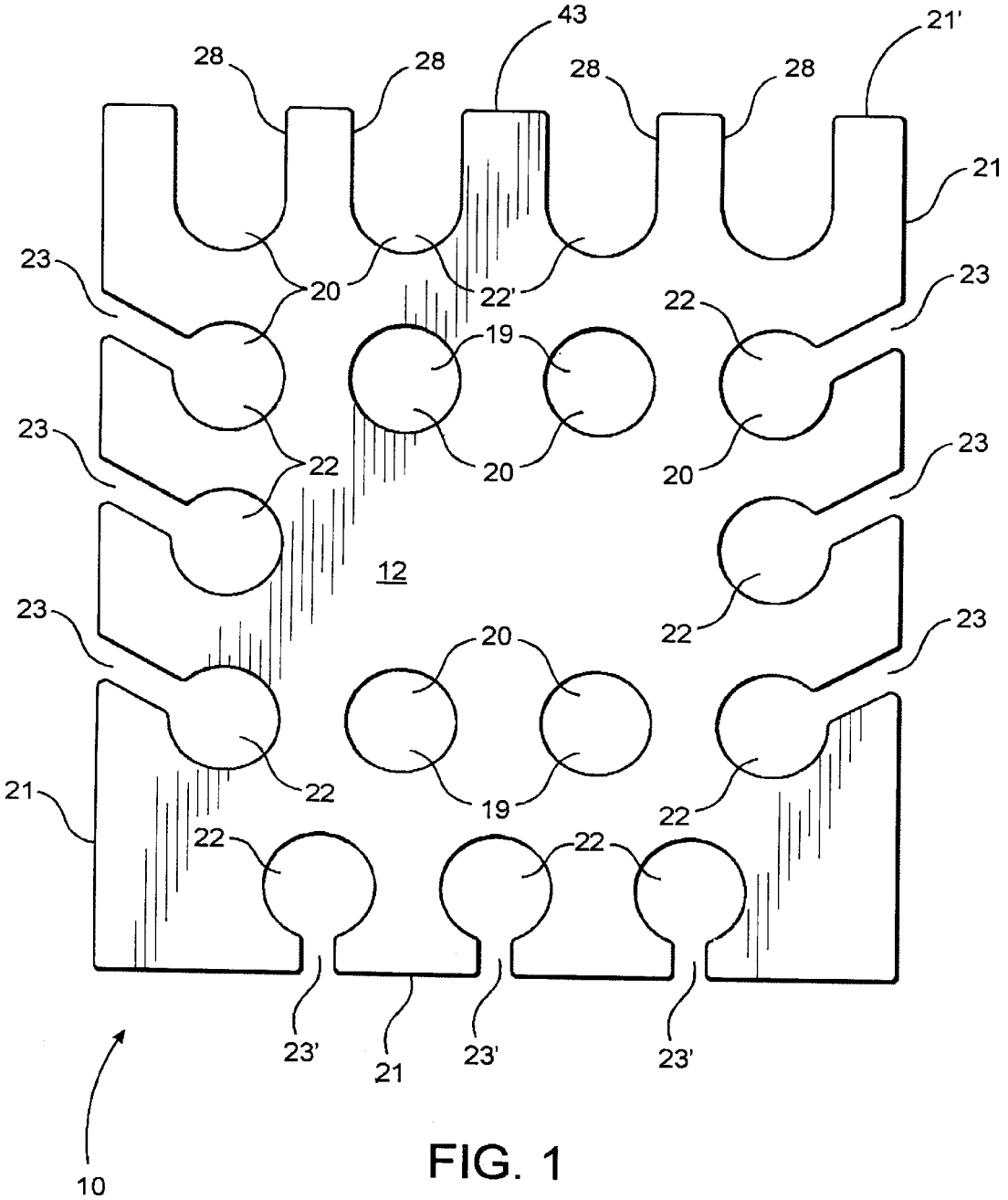
FIG. 1 is a front plan view of the mounting assembly of the present invention.

The gripping assembly 12 further comprises at least one but preferably a second group of apertures, herein defined as open apertures 22. Open apertures 22 each comprise an at least partially open circumferential configuration defined by at least one access opening 23 disposed in communicating relation between the interior of the open apertures 22 and a substantially adjacent or correspondingly disposed peripheral edge 21 or 21' of base 11. As shown in FIG. 1, the access openings 23 may be angularly oriented or alternatively may extend radially outward as at 23', between a corresponding peripheral edge 21 and the interior of the corresponding aperture 22. Accordingly, it is apparent that access openings 23 and 23' have a substantially lesser transverse dimension than that of the diameter of the open apertures 22 with which they are associated. In addition, one or more of the open apertures 22' may include an access opening 28, which have a transverse dimension substantially equal to the diameter of the open apertures 22'.

In either embodiment of the open apertures 22 or 221, an advantage of such an open circumferential configuration is the ability to place a microphone therein, without requiring the removal or detachment of the power or output cord secured to a number of conventional microphones. More over it is well established that numerous types of conventional microphones have the aforementioned power or output cords permanently attached to the tale end of the microphone, which eliminates the possibility of detaching such cords. In such instances, microphones of this types would not be able to be mounted on the base without the inclusion of the one or more open apertures 22,22' each of which includes at least one access opening 23, 23' and/or 28. While the different sizes of the access openings 23, 23' and 28 facilitates the passage of the cord there through, in certain instances it is more convenient to pass the base or housing of the microphone into the open apertures 22'. Therefore, the enlarged access openings 28 are provided to accommodate this situation. However, the one or more open apertures 22' may best be located in spaced relation to one another along a length of the upper most peripheral edge 21'. The support of the microphones placed within these apertures 22' is further enhanced due to the predetermined angular orientation or incline of the base 11 when mounted on a light stand 47 (see FIG. 2) or other conventional supporting structure.

In order to provide an adequate number of the plurality of apertures 20 while at the same time maintaining the preferred, organized, predetermined array of such apertures, the plurality of open apertures 22 and 22' are preferably disposed in spaced apart relation to one another along an adjacent or corresponding peripheral side edge 21 or 21' of the base 11. To the contrary the aforementioned closed apertures 19 are inwardly spaced from the peripheral side edges 21 and 21' and may be surrounded by the collection of open apertures 22 and 22'.

Figure 2:
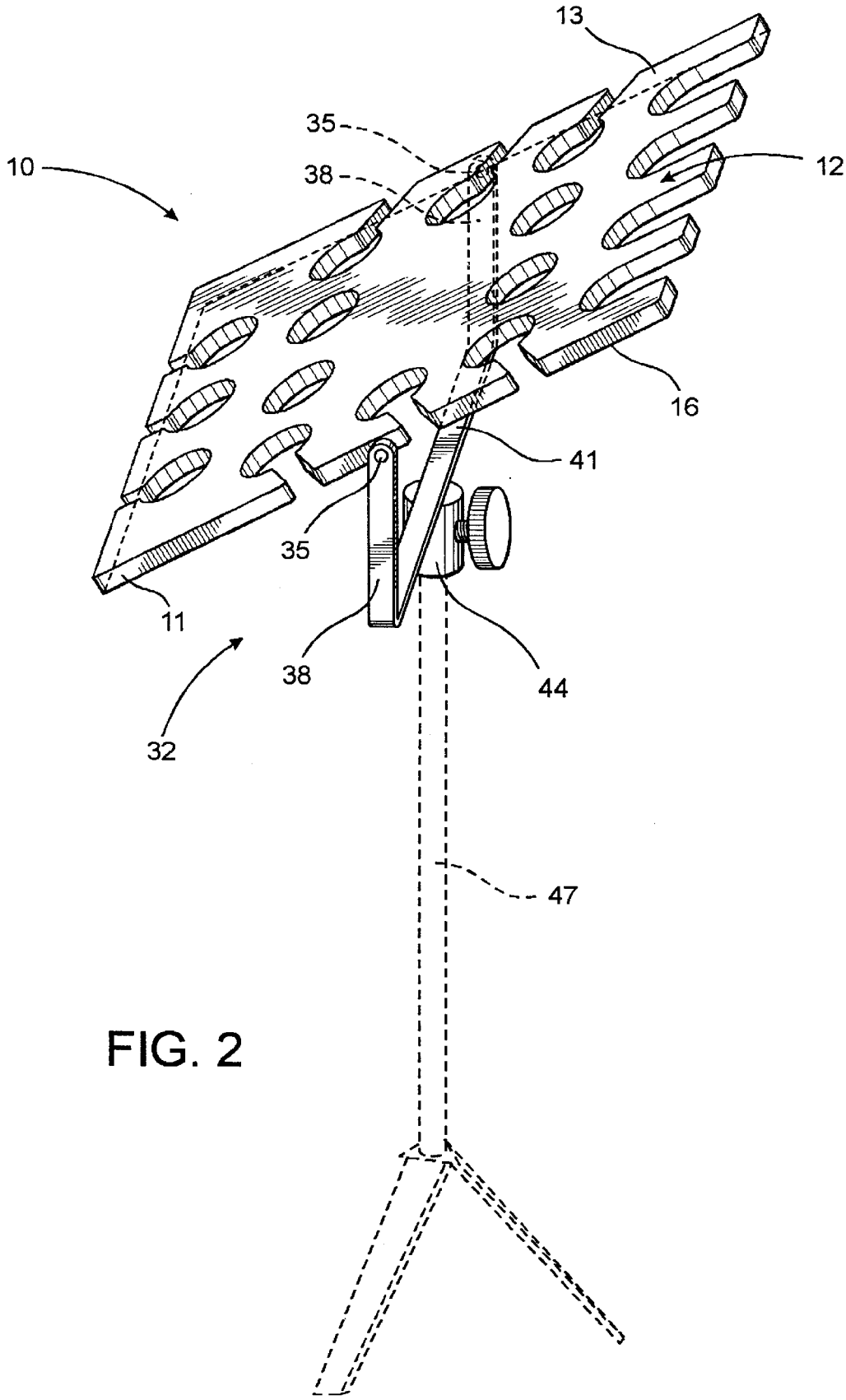
FIG. 2 is a side perspective view in partial phantom of the embodiment of FIG. 1.
Figure 3:
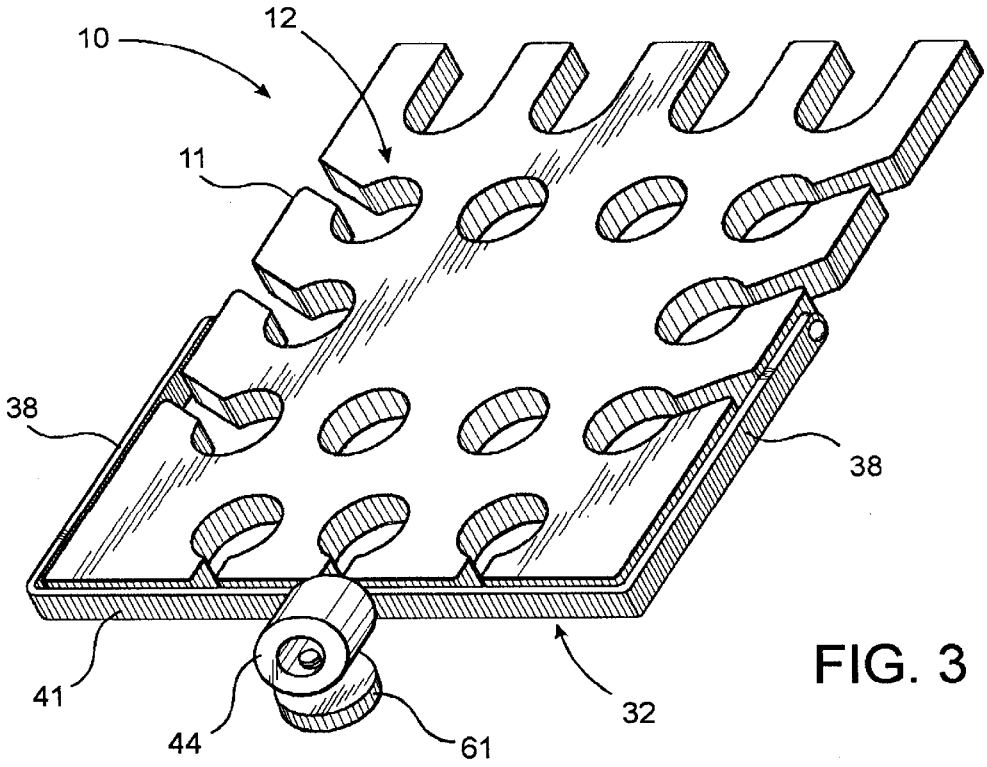
FIG. 3 is a front perspective view of embodiment of FIGS. 1 and 2.

The mounting assembly 10 also includes an attachment assembly generally indicated as 32 and shown in FIGS. 2 and 3. Attachment assembly 32 comprises a substantial U-shape having spaced apart support legs 38 and an interconnecting support arm 41. Support legs 38 each have a free end pivotally or otherwise attached to base 10 by member 35. Members 35 may be selectively adjusted, as by loosening or tightening, so as to selectively allow the positioning of base 11 between an operable position as shown in FIG. 2 and a stored position as shown in FIG. 3. In the operable position, the base 11 is maintained at an inclined position such that when the microphones are disposed within the plurality of apertures 20 of the gripping assembly 12, they are directed towards the speaker, performer or other audio source. In the stored position of FIG. 3, members 35 are loosened, and attachment assembly 32 is then aligned in a substantially co-planar relation to base 11. The members 35 are then again tightened to hold attachment assembly 32 in this substantially co-planar relation to the base 11.

Figure 6:
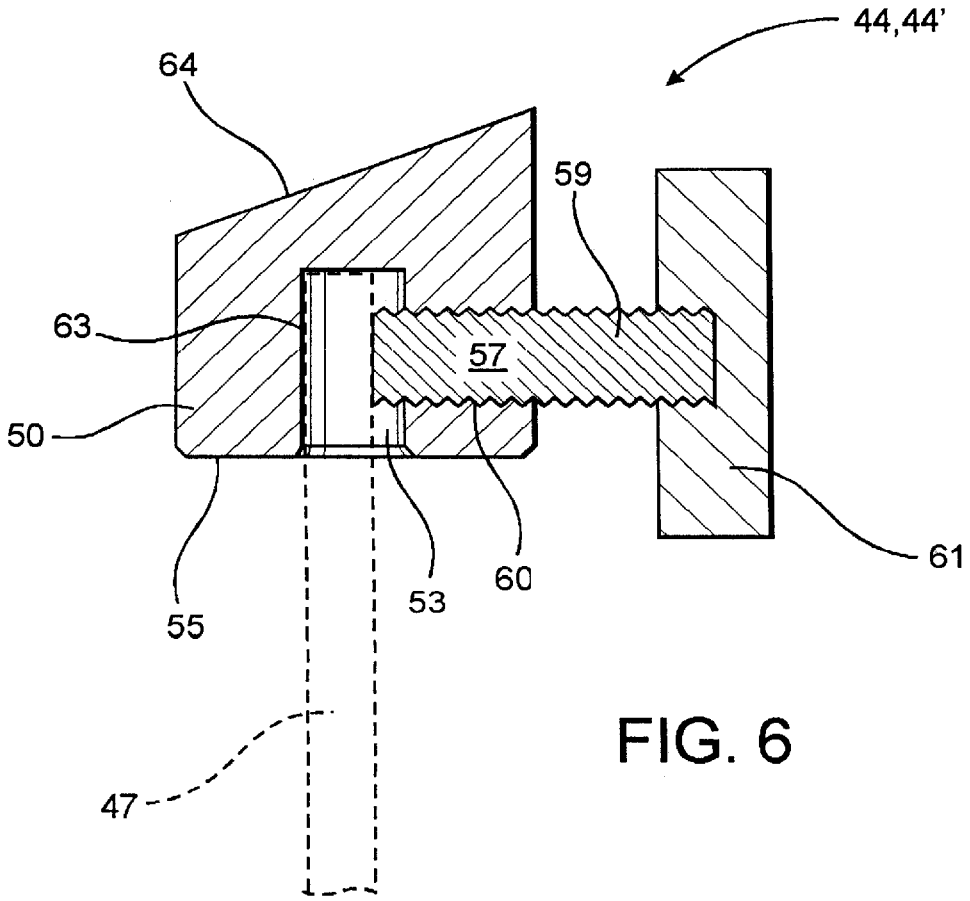
FIG. 6 is a longitudinal sectional view in partial phantom and cutaway of one embodiment of an attachment assembly associated with the mounting assembly of the present invention.

Located on interconnecting support arm 41 is connector device 44 structured to connect the attachment assembly 32 to a light stand 47 or other conventional support structure. Connector device 44 is represented in FIGS. 3 and 6, and comprises outer housing 64 which may be made of metal, plastic or some other equivalent material. Outer housing 64 defines a cavity 53, located within the interior of outer housing 64 and protruding through lower end 55. The cavity 53 is structured to receive the top end of a light stand 47 or other support structure. Within the side of outer housing 64 is a cavity including female threads 60 structured to receive a support or locking bolt 57 having external male threads 59, which at least partially defines a lock mechanism. By turning bolt handle 61 in a proper direction, bolt 57 is extended into central cavity 53 until it removable secures or locks light stand 47 into snug engagement with outer wall 63 of the central cavity 53.

Figure 7:
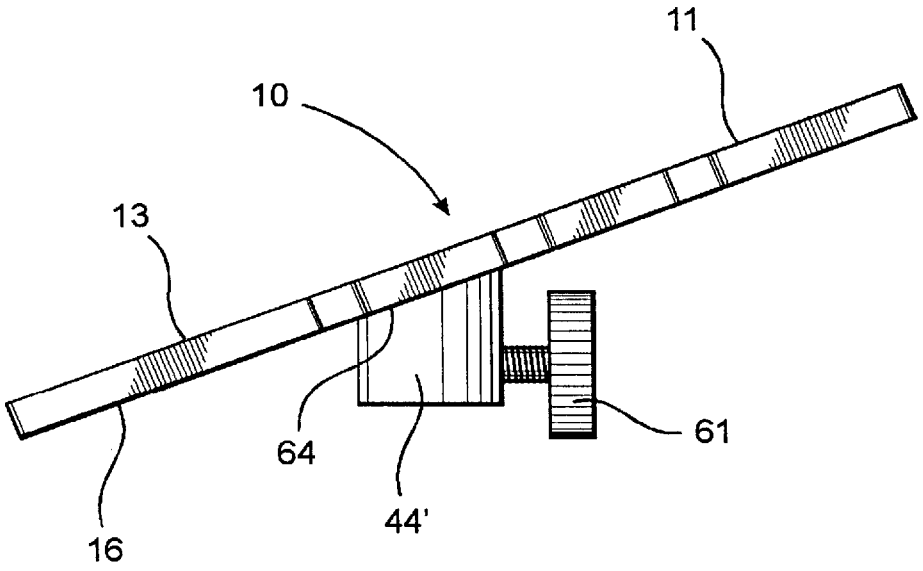
FIG. 7 is a side view of an alternative embodiment of the attachment assembly of the present invention.

The mounting assembly 10 of the present invention comprises an alternative embodiment of the attachment assembly which is best shown in FIG. 7 and is indicated as including connector device 44'. In this embodiment of the attachment assembly the connector device 44' has structural features equivalent to the connector device 44 described in detail with reference to FIG. 6 and associated with the first described embodiment of the attachment assembly generally indicated as 32. Accordingly, for purposes of clarity the connector device associated with the embodiment of FIG. 7, while being substantially structurally equivalent to the connector device 44 associated with the embodiment of the attachment assembly 32, will be designated 44'. However, in this embodiment the upper surface 64 has an angularly inclined orientation and is fixedly secured to the under surface 16 of the base 11 so as to permanently fix or maintain the base 11 at the aforementioned inclined position. In addition, adjustment of the locking bolt 57, by means of the exteriorly disposed knob or handle 61, will serve to removably but securely attach the connector device 44', and therefore base 11, to a free end of the light stand 47 or other conventional support structure (not shown for purposes of clarity).

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A mounting assembly for a plurality of microphones, said assembly comprising:

a) a base, b) said base having an outer surface disposed in a substantially exposed position and an under surface substantially oppositely disposed to said outer surface, said base positionable between an operable position and a stored position, c) an attachment assembly movably secured to said base and removably securable to a support structure, and d) a gripping assembly formed on said base and structured to removably secure a plurality of microphones on said base in a predetermined array.

2. An assembly as recited in claim 1 wherein said predetermined array is at least partially defined by the microphones disposed in a spaced, side-by-side relation to one another and in outwardly protruding relation from both said outer and under surfaces.

3. An assembly as recited in claim 1 wherein said gripping assembly comprises a plurality of apertures extending through said base in communicating relation with both said outer and under surfaces.

4. An assembly as recited in claim 3 wherein each of said apertures include a sufficient circumferential dimension to supportingly engage a microphone intermediate opposite ends thereof.

5. An assembly as recited in claim 4 wherein at least one of said plurality of apertures comprises a closed circumferential configuration.

6. An assembly as recited in claim 5 wherein at least one other of said plurality of apertures comprises an at least partially open circumferential configuration.

7. An assembly as recited in claim 6 wherein said open circumferential configuration is defined by an access opening disposed in communicating relation between said one other aperture and a peripheral edge of said base.

8. An assembly as recited in claim 7 wherein said access opening includes a lesser transverse dimension than the diameter of said one other aperture.

9. An assembly as recited in claim 8 wherein said access opening includes a transverse dimension substantially equal to the diameter of said one other aperture.

10. An assembly as recited in claim 4 wherein at least one of said apertures comprises an at least partially open circumferential configuration.

11. An assembly as recited in claim 10 wherein said open circumferential configuration is defined by an access opening disposed in communicating relation between the other of said one apertures and a peripheral edge of said base; said access opening including a lesser transverse dimension than the diameter of said one aperture.

12. An assembly as recited in claim 11 wherein said open circumferential configuration is defined by an access opening disposed in communicating relation between said one aperture and a peripheral edge of said base; said access opening including a transverse dimension substantially equal to the diameter of said one aperture.

13. An assembly as recited in claim 10 wherein said open circumferential configuration is defined by an access opening disposed in communicating relation between said one aperture and a peripheral edge of said base; said access opening including a transverse dimension substantially equal to the diameter of said one aperture.

14. An assembly as recited in claim 1 wherein said stored position is defined by an aligned, substantially co-planar relation between said attachment assembly and a said base.

15. An assembly as recited in claim 14 wherein said attachment assembly comprises a substantially u-shape including spaced apart legs pivotally secured to said base and sufficiently spaced from one another to allow disposition of said base between said legs and into and out of said stored position.

16. An assembly as recited in claim 1 wherein said attachment assembly is secured to said under surface of said base in inwardly spaced relation to the outer periphery of said base.

17. An assembly as recited in claim 16 wherein said attachment assembly is secured to said under surface and configured to dispose said base in a substantially inclined, angular orientation when said attachment assembly is secured to anyone of a plurality of different support structures.

18. An assembly as recited in claim 17 wherein said attachment assembly comprises a connector device fixedly mounted on said under surface, said connector structure including a lock mechanism mounted thereon.

* * * * *